US009236645B2

(12) United States Patent
Shiue

(10) Patent No.: US 9,236,645 B2
(45) Date of Patent: Jan. 12, 2016

(54) SERPENTINE DELAY LINE STRUCTURE

(71) Applicant: Chung Yuan Christian University, Chung Li (TW)

(72) Inventor: Guang-Hwa Shiue, Chung Li (TW)

(73) Assignee: CHUNG YUAN CHRISTIAN UNIVERSITY, Chung Li (TW)

( * ) Notice: Subject to any disclaimer, the term of this patent is extended or adjusted under 35 U.S.C. 154(b) by 2 days.

(21) Appl. No.: 14/276,803

(22) Filed: May 13, 2014

(65) Prior Publication Data

US 2015/0288050 A1 Oct. 8, 2015

(30) Foreign Application Priority Data

Apr. 2, 2014 (TW) ..... 103112335 A

(51) Int. Cl.
*H01P 9/00* (2006.01)
*H01P 1/18* (2006.01)

(52) U.S. Cl.
CPC ..... *H01P 9/006* (2013.01); *H01P 1/184* (2013.01); *H01P 9/00* (2013.01)

(58) Field of Classification Search
CPC ..... H01P 1/184; H01P 9/00; H01P 9/006
USPC ..... 333/161
See application file for complete search history.

(56) References Cited

U.S. PATENT DOCUMENTS 5,815,050 A * 9/1998 Brooks et al. ..... 333/161
2013/0015925 A1 * 1/2013 Shiue et al. ..... 333/161

* cited by examiner

*Primary Examiner* — Benny Lee
(74) *Attorney, Agent, or Firm* — Muncy, Geissler, Olds & Lowe, P.C.

(57) ABSTRACT

A serpentine delay line structure for reducing the common-mode noise is provided to a substrate having a layout layer, a first dielectric layer, a second dielectric layer, and a grounding layer. The serpentine delay line structure includes a first serpentine delay line pair, a second serpentine delay line pair, a third serpentine delay line pair, a first transition serpentine delay line pair, and a second transition serpentine delay line pair. The first serpentine delay line pair and the second serpentine delay line pair on the layout layer are electrically connected to the first transition serpentine delay line pair on the first dielectric layer through corresponding vertical vias. The second serpentine delay line pair and the third serpentine delay line pair on the layout layer are electrically connected to the second transition serpentine delay line pair on the first dielectric layer through corresponding vertical vias.

7 Claims, 9 Drawing Sheets

SERPENTINE DELAY LINE STRUCTURE

This application claims the benefit of Taiwan Patent Application Serial No. 103112335, filed Apr. 2, 2014, the subject matter of which is incorporated herein by reference.

BACKGROUND OF INVENTION

1. Field of the Invention

The invention relates to a serpentine delay line structure, and more particularly to a serpentine delay line structure that includes plural winding serpentine delay line pairs mounted on the dielectric layer.

2. Description of the Prior Art

As communication technology prospers, various high-frequency electronic products appear and become the mainstream products in the marketplace. Also, the transmission speed of digital signals has increased dramatically. However, some communication problems for this high-frequency high-speed electronic industry, such as electromagnetic interference (EMI), electromagnetic compatibility (EMC), signal integrity (SI), power integrity (PI), and so on, are raised due to the increase in the transmission speed, and these problems affect the signal quality and integrity of the related circuits.

In addition, in a high-frequency system, the conventional single-ended signal wire can no longer meet the system's requirements, and thus, cannot ensure proper signal integrity. Therefore, for a modern high-frequency high-speed digital system, a method of applying differential signal line pairs to process the signal transmission is usually introduced to overcome the problems in common-mode noise and noise interference. Currently, various mainstream specifications for this method, including HDMI (High Definition Multimedia Interface 1.4/5 Gb/s), SATA (Serial Advanced Technology Attachment), USB3.0, PCI Express, Thunderbolt™, and so on, are all the application of the differential mode transmission. Nevertheless, if the differential signal line pair is not properly arranged, timing of the received signal would be unsynchronized, and thus the common-mode noise would be induced.

For example, refer to FIG. 1 for a conventional structure of a differential serpentine delay line. The serpentine delay line is usually seen on the printed circuit board for the aforesaid high-frequency high-speed products. As shown, the differential serpentine delay line PA1 consists two serpentine delay lines PA11 and PA12, in which the serpentine delay lines PA11 and PA12 are repeatedly bent on the substrate PA100.

However, since the travel paths for these two serpentine delay lines would differ, due to the winding, the timing for receiving the signals transmitted through these two individual serpentine delay lines would show a time lag, and thus, a common-mode noise would be induced. Obviously, the structuring of the conventional serpentine delay line, as shown in FIG. 1, does need further improvement.

SUMMARY OF THE INVENTION

In view of the conventional serpentine delay line structure, the winding or bending feature in the lining would result in different signal-transmission lengths, and thus, a common-mode noise is induced by the time lag in receiving the signals travelling therethrough. Accordingly, it is the primary object of the present invention to provide a serpentine delay line structure where the bending portion of the serpentine delay line pair is arranged to another dielectric layer, so as to avoid transmission time lag by equalizing the travel paths in this bending portion.

In the present invention, the serpentine delay line structure laid on a serpentine delay line structure includes a first serpentine delay line pair, a second serpentine delay line pair, a first transition serpentine delay line pair, a third serpentine delay line pair and a second transition serpentine delay line pair, and the substrate has a layout layer, a first dielectric layer, a second dielectric layer and a grounding layer. The first serpentine delay line pair, being laid or located on the layout layer, includes a first serpentine delay line and a second serpentine delay line, and these two serpentine delay line are connected electrically at an input end. The first serpentine delay line is extended from the input end to a first via along a first extension direction, and the second serpentine delay line parallel to the first serpentine delay line is extended from the input end to a second via along the same first extension direction. The second serpentine delay line pair, parallel to the first serpentine delay line pair on the same layout layer, includes a third serpentine delay line and a fourth serpentine delay line; in which the third serpentine delay line is extended from a third via to a fourth via along a second extension direction opposite in direction to the first extension direction, and the fourth serpentine delay line parallel to the third serpentine delay line is extended from a fifth via to a sixth via along the same second extension direction.

The first transition serpentine delay line pair, being laid on the first dielectric layer, includes a fifth serpentine delay line and a sixth serpentine delay line. The fifth serpentine delay line is electrically connected with the first via and the fifth via so as to establish an electric connection between the first serpentine delay line and the fourth serpentine delay line. The sixth serpentine delay line parallel to the fifth serpentine delay line is electrically connected with the second via and the third via so as to establish an electric connection between the second serpentine delay line and the third serpentine delay line. The third serpentine delay line pair, parallel to both the first serpentine delay line pair and the second serpentine delay line pair and laid on the layout layer, includes a seventh serpentine delay line and an eighth serpentine delay line, and these two serpentine lines are electrically coupled at an output end. The seventh serpentine delay line is extended from a seventh via to the output end along the first extension direction, and the eighth serpentine delay line parallel to the seventh serpentine delay line is extended from an eighth via to the output end along the first extension direction. The second transition serpentine delay line pair, being laid on the first dielectric layer, includes a ninth serpentine delay line and a tenth serpentine delay line; in which the ninth serpentine delay line is electrically connected with the sixth via and seventh via so as to establish an electric connection between the fourth serpentine delay line and the seventh serpentine delay line, and the tenth serpentine delay line parallel to the ninth serpentine delay line is electrically connected with the fourth via and the eighth via so as to establish an electric connection between the third serpentine delay line and the eighth serpentine delay line.

In one embodiment of the present invention, the second serpentine delay line further includes a first main serpentine delay line segment, a first transition serpentine delay line segment and a first auxiliary serpentine delay line segment. The first main serpentine delay line segment is extended from the input end and has a first width. The first transition serpentine delay line segment is connected between the first main serpentine delay line segment and the first auxiliary serpentine delay line segment. The first auxiliary serpentine delay line segment is extended to the second via and has a second width. Preferably, the second width is smaller than the first width. Further, the third serpentine delay line includes a second main serpentine delay line segment, a second transition serpentine delay line segment and a second auxiliary serpentine delay line segment. The second main serpentine delay line segment is extended to the fourth via and has a third width. The second transition serpentine delay line segment is connected between the second main serpentine delay line segment and the second auxiliary serpentine delay line segment. The second auxiliary serpentine delay line segment is extended from the third via and has a fourth width. Preferably, the fourth width is smaller than the third width.

In one embodiment of the present invention, the fourth serpentine delay line further includes a third main serpentine delay line segment, a third transition serpentine delay line segment and a third auxiliary serpentine delay line segment. The third main serpentine delay line segment is extended from the fifth via and has a fifth width. The third transition serpentine delay line segment is connected between the third main serpentine delay line segment and the third auxiliary serpentine delay line segment. The third auxiliary serpentine delay line segment is extended to the sixth via and has a sixth width. Preferably, the sixth width is smaller than the fifth width. In addition, the seventh serpentine delay line includes a fourth main serpentine delay line segment, a fourth transition serpentine delay line segment and a fourth auxiliary serpentine delay line segment. The fourth main serpentine delay line segment is extended to the output end and has a seventh width. The fourth transition serpentine delay line segment is connected between the fourth main serpentine delay line segment and the fourth auxiliary serpentine delay line segment. The fourth auxiliary serpentine delay line segment is extended from the seventh via and has an eighth width. Preferably, the eighth width is smaller than the seventh width.

In one embodiment of the present invention, each of the first serpentine delay line pair, the second serpentine delay line pair, the third serpentine delay line pair, the first transition serpentine delay line pair and the second transition serpentine delay line pair can be formed by either microstrip lines or embedded microstrip lines. In addition, the substrate can further include a grounding layer, and the substrate is laminated in order by the layout layer, the first dielectric layer, the second dielectric layer and the grounding layer.

By providing the serpentine delay line structure of the present invention, the bending portions of the serpentine delay line are led to be constructed on another dielectric layer so that the common-mode noise caused by communication time lag resulting from different transmission lengths at these bending portions can be substantially reduced.

Further, by providing the serpentine delay line structure of the present invention, since the widths of the delay lines at the cross-pass portions of the vertical segments and the horizontal segments can be made thinner, the induced disadvantageous capacitive effect can be reduced, such that better signal integrity can be obtained.

All these objects are achieved by the serpentine delay line structure described below.

BRIEF DESCRIPTION OF THE DRAWINGS

The present invention will now be specified with reference to its preferred embodiment illustrated in the drawings, in which.

DETAILED DESCRIPTION OF THE PREFERRED EMBODIMENT

Figure 1:
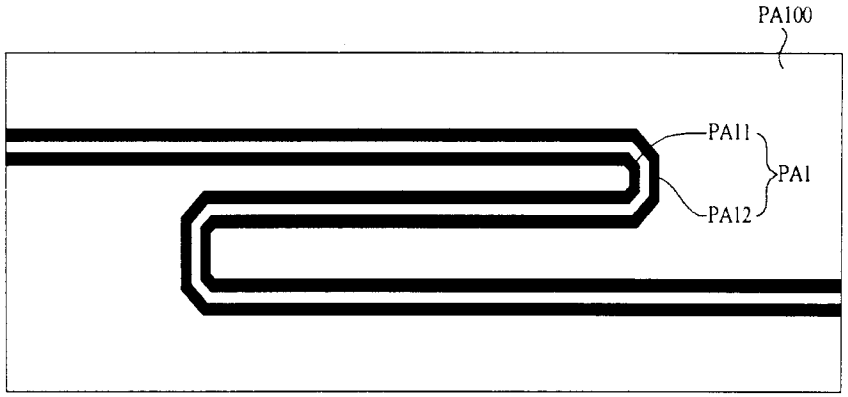
FIG.1(Prior Art)
FIG. 1 shows a conventional differential serpentine delay line structure.

The invention disclosed herein is directed to a serpentine delay line structure. In the following description, numerous details are set forth in order to provide a thorough understanding of the present invention. It will be appreciated by one skilled in the art that variations of these specific details are possible while still achieving the results of the present invention. In other instances, well-known components are not described in detail in order not to unnecessarily obscure the present invention. The same reference numeral denotes corresponding elements or parts of the embodiment and modifications of the invention throughout the drawings.

Figure 2:
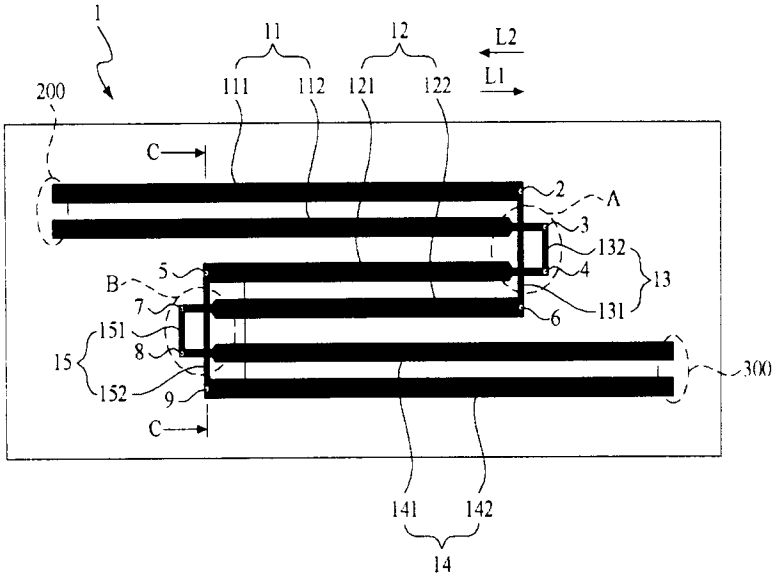
FIG. 2 is a top view of a preferred embodiment of the serpentine delay line structure in accordance with the present invention.
Figure 2A:
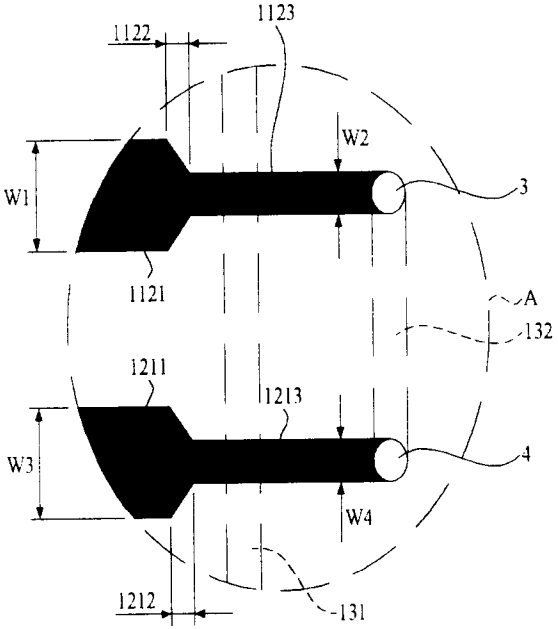
FIG. 2A is an enlarged view of circle A of FIG. 2.
Figure 2B:
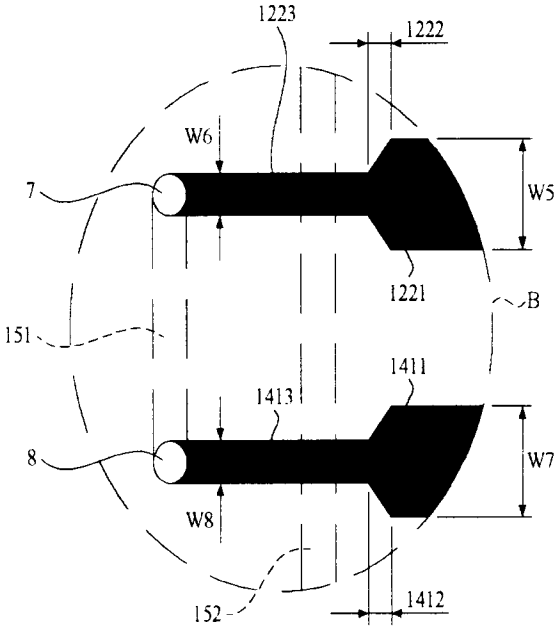
FIG. 2B is an enlarged view of circle B of FIG. 2.
Figure 3:
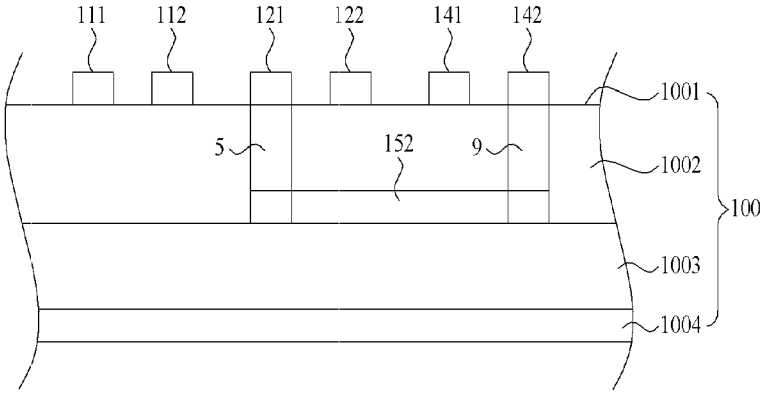
FIG. 3 is a schematic side view of FIG. 2.

Refer to FIGS. 2, 2A, 2B and FIG. 3, in which FIG. 2 is a top view of a preferred embodiment of the serpentine delay line structure in accordance with the present invention. FIG. 2A is an enlarged view of circle A of FIG. 2. FIG. 2B is an enlarged view of circle B of FIG. 2, and FIG. 3 is a schematic side view along line C-C of FIG. 2.

As shown in FIG. 2, the serpentine delay line structure 1 of the present invention is laid on a substrate 100, in which the substrate 100 is consisted of and laminated in order by a layout layer 1001, a first dielectric layer 1002, a second dielectric layer 1003 and a grounding layer 1004, as shown in FIG. 3. Namely, the layout layer 1001 is layered on top of the first dielectric layer 1002, the second dielectric layer 1003 is layered on top of the grounding layer 1004 but below the first dielectric layer 1002. The dielectric coefficient for the first dielectric layer 1002 and the second dielectric layer 1003 can be the same or different, for example 4.5 for both of them, and also the height thereof can be the same or different. All these parameters actually depend on the requirements and may vary from time to time.

In this embodiment, the serpentine delay line structure 1 includes a first serpentine delay line pair 11, a second serpentine delay line pair 12, a first transition serpentine delay line pair 13, a third serpentine delay line pair 14 and a second transition serpentine delay line pair 15, as illustrated in FIG. 2. However, in other embodiments, more delay line pairs can be included.

The first serpentine delay line pair 11 is laid on the layout layer 1001 and is electrically integrated at an input end 200 thereof. As shown, the first serpentine delay line pair 11 includes a first serpentine delay line 111 and a second serpentine delay line 112, in which the first serpentine delay line 111 is extended from the input end 200 to a first via 2 along a first extension direction L1, while the second serpentine delay line 112 parallel to the first serpentine delay line 111 is extended from the input end 200 to a second via 3 along the same first extension direction L1.

Practically, as illustrated in FIG. 2A, the second serpentine delay line 112 includes a first main serpentine delay line segment 1121, a first transition serpentine delay line segment 1122 and a first auxiliary serpentine delay line segment 1123. The first main serpentine delay line segment 1121 is extended from the input end 200 and has a first width W1. The first transition serpentine delay line segment 1122 is connected with and located between the first main serpentine delay line segment 1121 and the first auxiliary serpentine delay line segment 1123. The first auxiliary serpentine delay line segment 1123 is extended to second via 3 and has a second width W2. Preferably, the second width W2 is smaller than the first width W1. Namely, the first transition serpentine delay line segment 1122 is tapered from the first width W1 to the second width W2.

The second serpentine delay line pair 12 parallel to the first serpentine delay line pair 11 is laid on the layout layer 1001 and includes a third serpentine delay line 121 and a fourth serpentine delay line 122. The third serpentine delay line 121 is extended from a third via 4 to a fourth via 5 along a second extension direction L2 opposing in direction to the first extension direction L1. The fourth serpentine delay line 122 parallel to third serpentine delay line 121 is extended from a fifth via 6 to a sixth via 7 along the second extension direction L2.

Practically, as illustrated in FIG. 2A, the third serpentine delay line 121 includes a second main serpentine delay line segment 1211, a second transition serpentine delay line segment 1212 and a second auxiliary serpentine delay line segment 1213. The second main serpentine delay line segment 1211 is extended to the fourth via 5 and has a third width W3. Preferably, the third width W3 is equal to the first width W1. The second transition serpentine delay line segment 1212 is connected between the second main serpentine delay line segment 1211 and the second auxiliary serpentine delay line segment 1213. The second auxiliary serpentine delay line segment 1213 is extended from the third via 4 and has a fourth width W4. Preferably, the fourth width W4 is smaller than the third width W3. Namely, the second transition serpentine delay line segment 1212 is tapered from the third width W3 to the fourth width W4.

Further, as illustrated in FIG. 2B, the fourth serpentine delay line 122 includes a third main serpentine delay line segment 1221, a third transition serpentine delay line segment 1222 and a third auxiliary serpentine delay line segment 1223. The third main serpentine delay line segment 1221 is extended from the fifth via 6 and has a fifth width W5. The third transition serpentine delay line segment 1222 is connected between the third main serpentine delay line segment 1221 and the third auxiliary serpentine delay line segment 1223. The third auxiliary serpentine delay line segment 1223 is extended to the sixth via 7 and has a sixth width W6. Preferably, the sixth width W6 is smaller than the fifth width W5. Namely, the third transition serpentine delay line segment 1222 is tapered from the fifth width W5 to the sixth width W6.

The first transition serpentine delay line pair 13 is laid on the first dielectric layer 1002 and includes a fifth serpentine delay line 131 and a sixth serpentine delay line 132. As shown in FIG. 2, the fifth serpentine delay line 131 is electrically connected with the first via 2 and the fifth via 6, and thereby further connected electrically connected to the first serpentine delay line 111 and the fourth serpentine delay line 122, respectively. The sixth serpentine delay line 132 parallel to the fifth serpentine delay line 131 laid right to the fifth serpentine delay line 131 and is electrically connected with the second via 3 and the third via 4, and thereby further electrically connected to the second serpentine delay line 112 and the third serpentine delay line 121, respectively. In addition, the fifth serpentine delay line 131 is longer than the sixth serpentine delay line 132, but both have the same width. It is noted that the width for either the fifth serpentine delay line 131 or the sixth serpentine delay line 132 is the same as each of the second width W2, the fourth width W4, the sixth width W6 and the eighth width W8, with W2 and W4 being shown in FIG. 2A and W6 and W8 being shown in FIG. 2B. Nevertheless, in other embodiments, such an equal width is not necessary.

As shown in FIG. 2, the third serpentine delay line pair 14, parallel to first serpentine delay line pair 11 and the second serpentine delay line pair 12, is laid on the layout layer 1001 and includes a seventh serpentine delay line 141 and an eighth serpentine delay line 142, in which the seventh serpentine delay line 141 and an eighth serpentine delay line 142 are electrically connected at an output end 300. The seventh serpentine delay line 141 is extended from a seventh via 8 to the output end 300 along the first extension direction L1, while the eighth serpentine delay line 142 parallel to seventh serpentine delay line 141 is extended from an eighth via 9 to the output end 300 along the first extension direction L1.

Practically, as shown in FIG. 2B, the seventh serpentine delay line 141 includes a fourth main serpentine delay line segment 1411, a fourth transition serpentine delay line segment 1412 and a fourth auxiliary serpentine delay line segment 1413. The fourth main serpentine delay line segment 1411 is extended to the output end 300 and has a seventh width W7, equal to each of the first width W1, the third width W3 and the fifth width W5. The fourth transition serpentine delay line segment 1412 is connected between the fourth main serpentine delay line segment 1411 and the fourth auxiliary serpentine delay line segment 1413. The fourth auxiliary serpentine delay line segment 1413 is extended from the seventh via 8 and has an eighth width W8. Preferably, the eighth width W8 is smaller than the seventh width W7. Namely, the fourth transition serpentine delay line segment 1412 is tapered from the seventh width W7 to the eighth width W8.

The second transition serpentine delay line pair 15 laid on the first dielectric layer 1002 includes a ninth serpentine delay line 151 and a tenth serpentine delay line 152. The ninth serpentine delay line 151 is connected electrically with the sixth via 7 and the seventh via 8, and thereby further electrically connected to the fourth serpentine delay line 122 and the seventh serpentine delay line 141, respectively. The tenth serpentine delay line 152 parallel to the ninth serpentine delay line 151 by locating right to the ninth serpentine delay line 151 is electrically connected with the fourth via 5 and the eighth via 9, and thereby further electrically connected to the third serpentine delay line 121 and the eighth serpentine delay line 142, respectively. In addition, the tenth serpentine delay line 152 is longer than the ninth serpentine delay line 151, but with the same width. It is noted that the width for either the ninth serpentine delay line 151 or the tenth serpentine delay line 152 is the same as each of the second width W2, the fourth width W4, the sixth width W6 and the eighth width W8. However, in other embodiments, such a limitation in width and length is not necessary.

Furthermore, the first serpentine delay line pair 11, the second serpentine delay line pair 12, the first transition serpentine delay line pair 13, the third serpentine delay line pair 14 and the second transition serpentine delay line pair 15 can be individually formed by normal microstrip lines or by embedded microstrip lines.

Also, as shown in FIG. 2A, the second serpentine delay line 112 and the third serpentine delay line 121 are tapered already before they both cross in space to pass the fifth serpentine delay line 131. Namely, the first transition serpentine delay line segment 1122 and the second transition serpentine delay line segment 1212 are located on the same horizontal surface, but the fifth serpentine delay line 131 is on another horizontal surface bottom to the aforesaid surface locating the first transition serpentine delay line segment 1122 and the second transition serpentine delay line segment 1212. Similarly, as shown in FIG. 2B, the fourth serpentine delay line 122 and the seventh serpentine delay line 141 are tapered already before they both cross in space to pass the tenth serpentine delay line 152. Namely, the third transition serpentine delay line segment 1222 and the fourth transition serpentine delay line segment 1412 are located on the same horizontal surface, but the tenth serpentine delay line 152 is on another horizontal surface bottom to the aforesaid surface locating the third transition serpentine delay line segment 1222 and the fourth transition serpentine delay line segment 1412. Upon the aforesaid arrangement, the common-mode noise can be further prohibited.

Figure 4:
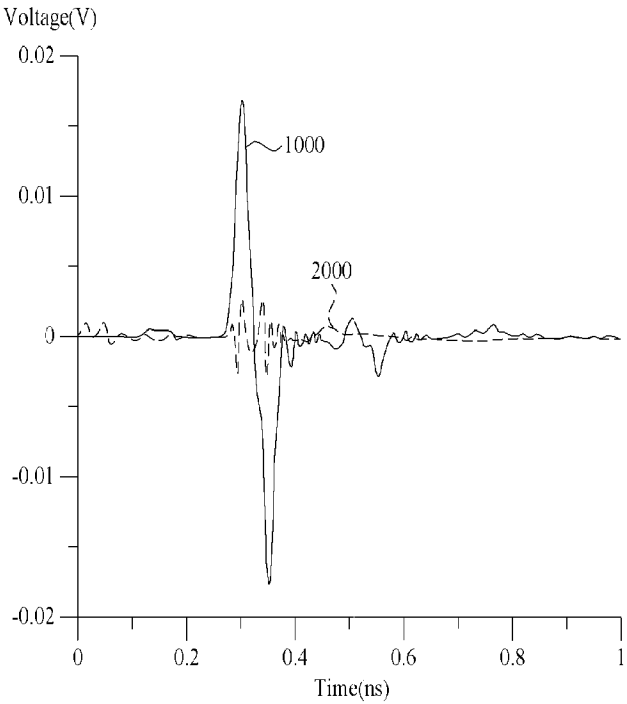
FIG. 4 illustrates the waveform analysis in the first time domain between the preferred embodiment of the present invention and the prior art.
Figure 4A:
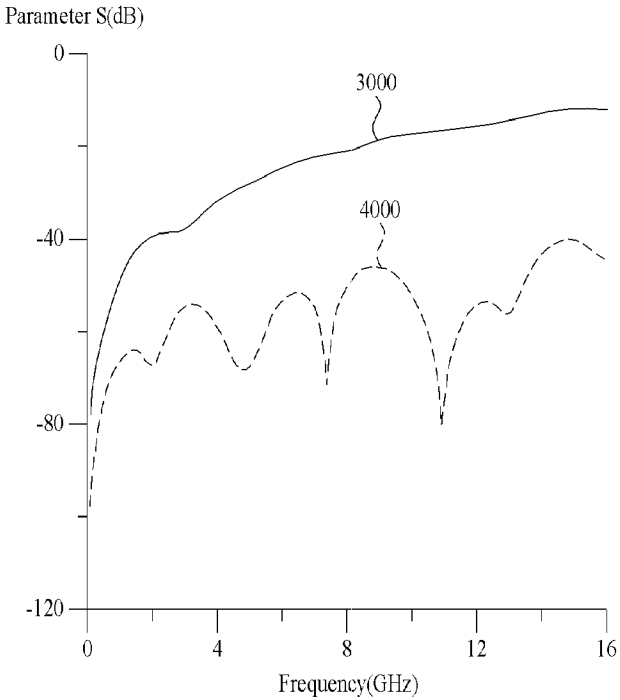
FIG. 4A illustrates the waveform analysis in the first frequency domain between the preferred embodiment of the present invention and the prior art.
Figure 5:
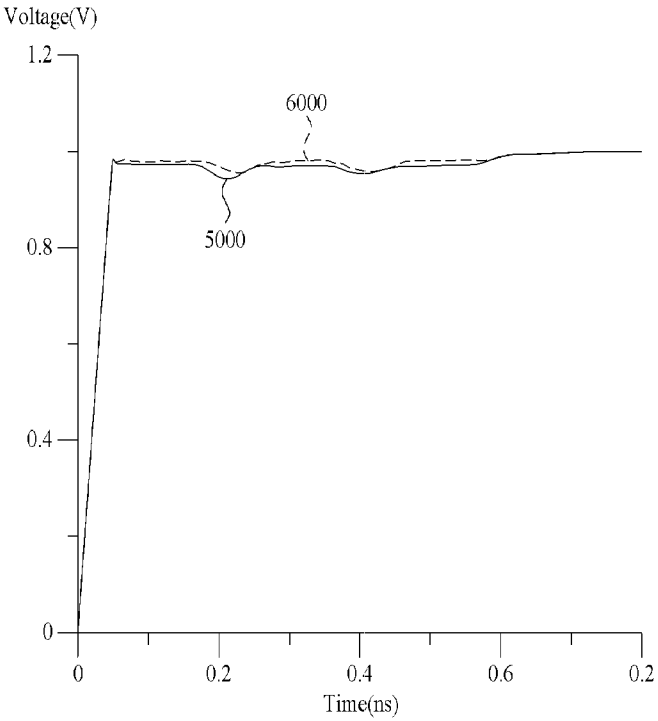
FIG. 5 illustrates the waveform analysis in the second time domain between the preferred embodiment of the present invention and the prior art.
Figure 5A:
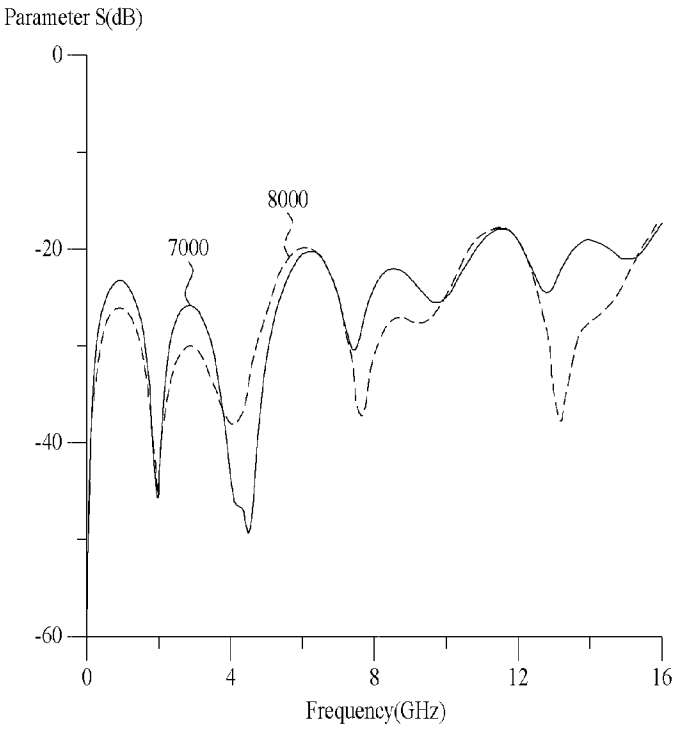
FIG. 5A illustrates the waveform analysis in the second frequency domain between the preferred embodiment of the present invention and the prior art.

By comparing the serpentine delay line structure 1 of the present invention to the conventional differential serpentine delay line structure PA1, test results are provided from FIGS. 4 and 4A, FIG. 5 and FIG. 5A; in which FIG. 4 illustrates the waveform analysis of Voltage (V) and Time (ns) along the vertical and horizontal axes, respectively, in the first time domain between the preferred embodiment of the present invention and the prior art (the common-mode noise waveform received at the output end), FIG. 4A illustrates the waveform analysis of Parameter S (dB) and Frequency (GHz) along the vertical and horizontal axes, respectively, in the first frequency domain between the preferred embodiment of the present invention and the prior art (the vertical axis |Scd21| stands for the common-mode waveform received at the output end), FIG. 5 illustrates the waveform analysis of Voltage (V) and Time (ns) along the vertical and horizontal axes, respectively, in the second time domain between the preferred embodiment of the present invention and the prior art (the reflective waveform received at the input end), and FIG. 5A illustrates the waveform analysis of Parameter S (dB) and Frequency (GHz) along the vertical and horizontal axes, respectively, in the second frequency domain between the preferred embodiment of the present invention and the prior art (the vertical axis |Sdd11| stands for the reflective waveform received at the input end).

As illustrated respectively in FIGS. 4 and 4A, FIG. 5 and FIG. 5A, waveforms 1000, 3000, 5000 and 7000 are obtained by simulating the differential serpentine delay line PA1, while waveforms 2000, 4000, 6000 and 8000 are obtained by simulating the serpentine delay line structure 1 of the present invention, as also illustrated respectively in FIGS. 4 and 4A, FIG. 5 and FIG. 5A. As shown in FIG. 4 and FIG. 4A, from the comparisons between the waveform 1000 and the waveform 2000 and between the waveform 3000 and the waveform 4000, it is noted that, either in the time domain or in the frequency domain, from a differential mode to a common mode, amplitudes for the waveforms 1000 and 3000 are larger than those for the waveforms 2000 and 4000. Namely, by applying the differential serpentine delay line structure 1 with inter-layer changing layouts in accordance with the present invention, the notorious common-mode noise can be successfully reduced.

As shown in FIG. 5 and FIG. 5A, by comparing the waveform 5000 to the waveform 6000 and the waveform 7000 to the waveform 8000, it is also noted that, either in the time domain or in the frequency domain, amplitudes of the waveforms 5000 and 7000 are larger than that of the waveforms 6000 and 8000. Namely, by applying the differential serpentine delay line structure 1 with inter-layer changing layouts in accordance with the present invention, the signal integrity can be better ensured.

Further, for the present invention introduces the technique of tapering the second serpentine delay line 112 and the third serpentine delay line 121 prior to cross-passing the fifth serpentine delay line 131 and the technique of tapering the fourth serpentine delay line 122 and the seventh serpentine delay line 141 prior to cross-passing the tenth serpentine delay line 152, the capacitive effect in these cross sections can be greatly reduced, and thus better signal integrity can be achieved.

By providing the present invention, the conventional bending arrangement in the serpentine delay line structure has been improved by the switching the layout to another dielectric layer (the first dielectric layer), such that the transmission time lag in these areas would be substantially avoided and thereby the common-mode noise can be successfully reduced.

Further, since the line width in the cross-passing areas is reduced in the present invention, the capacitive effect would be greatly decreased. Thus, the common-mode noise would be reduced, and also the signal integrity for the circuiting can be improved.

While the present invention has been particularly shown and described with reference to a preferred embodiment, it will be understood by those skilled in the art that various changes in form and detail may be without departing from the spirit and scope of the present invention.

What is claimed is:

1. A serpentine delay line structure, applied to a substrate having a layout layer, a first dielectric layer and a second dielectric layer, comprising:

a first serpentine delay line pair, located on the layout layer, the first serpentine delay line pair being electrically connected at a common input end thereof, the first serpentine delay line pair further comprising:

a first serpentine delay line, extending from the input end to a first via along a first extension direction; and a second serpentine delay line, parallel to the first serpentine delay line, extending from the input end to a second via along the first extension direction;

a second serpentine delay line pair, parallel to the first serpentine delay line pair, located on the layout layer, the second serpentine delay line pair further comprising:

a third serpentine delay line, extending from a third via to a fourth via along a second extension direction opposite to the first extension direction; and a fourth serpentine delay line, parallel to the third serpentine delay line, extending from a fifth via to a sixth via along the second extension direction;

a first transition serpentine delay line pair, located on the first dielectric layer, the first transition serpentine delay line pair further comprising:

a fifth serpentine delay line, electrically connected with the first via and the fifth via so as to electrically connect the first serpentine delay line and the fourth serpentine delay line; and a sixth serpentine delay line, parallel to the fifth serpentine delay line, electrically connected with the second via and the third via so as to electrically connect the second serpentine delay line and the third serpentine delay line;

a third serpentine delay line pair, parallel to the first serpentine delay line pair and the second serpentine delay line pair, located on the layout layer, electrically connected at an output end thereof, the third serpentine delay line pair further comprising:

a seventh serpentine delay line, extending from a seventh via to the output end along the first extension direction; and an eighth serpentine delay line, parallel to the seventh serpentine delay line, extending from an eighth via to the output end along the first extension direction; and a second transition serpentine delay line pair, located on the first dielectric layer, the second transition serpentine delay line pair further comprising:

a ninth serpentine delay line, electrically connected with the sixth via and the seventh via so as to electrically connect the fourth serpentine delay line and the seventh serpentine delay line; and a tenth serpentine delay line, parallel to the ninth serpentine delay line, electrically connected with the fourth via and the eighth via so as to electrically connect the third serpentine delay line and eighth serpentine delay line.

2. The serpentine delay line structure of claim 1, wherein the second serpentine delay line further includes a first main serpentine delay line segment, a first transition serpentine delay line segment and a first auxiliary serpentine delay line segment, the first main serpentine delay line segment is extended from the input end and has a first width, the first transition serpentine delay line segment is connected to and located between the first main serpentine delay line segment and the first auxiliary serpentine delay line segment, the first auxiliary serpentine delay line segment is extended from the second via and has second width, and the second width is smaller than the first width.

3. The serpentine delay line structure of claim 1, wherein the third serpentine delay line further includes a second main serpentine delay line segment, a second transition serpentine delay line segment and a second auxiliary serpentine delay line segment, the second main serpentine delay line segment is extended from the fourth via and has a third width, the second transition serpentine delay line segment is connected to and located between the second main serpentine delay line segment and the second auxiliary serpentine delay line segment, the second auxiliary serpentine delay line segment is extended from the third via and has a fourth width, and the fourth width is smaller than the third width.

4. The serpentine delay line structure of claim 1, wherein the fourth serpentine delay line further includes a third main serpentine delay line segment, a third transition serpentine delay line segment and a third auxiliary serpentine delay line segment, the third main serpentine delay line segment is extended from the fifth via and has a fifth width, the third transition serpentine delay line segment is connected to and located between the third main serpentine delay line segment and the third auxiliary serpentine delay line segment, the third auxiliary serpentine delay line segment is extended from the sixth via and has a sixth width, and the sixth width is smaller than the fifth width.

5. The serpentine delay line structure of claim 1, wherein the seventh serpentine delay line further includes a fourth main serpentine delay line segment, a fourth transition serpentine delay line segment and a fourth auxiliary serpentine delay line segment, the fourth main serpentine delay line segment is extended to the output end and has a seventh width, the fourth transition serpentine delay line segment is connected to and located between the fourth main serpentine delay line segment and the fourth auxiliary serpentine delay line segment, the fourth auxiliary serpentine delay line segment is extended from the seventh via and has an eighth width, and the eighth width is smaller than the seventh width.

6. The serpentine delay line structure of claim 1, wherein the first serpentine delay line pair, the second serpentine delay line pair, the third serpentine delay line pair, the first transition serpentine delay line pair and the second transition serpentine delay line pair are all formed by one of microstrip lines and embedded microstrip lines.

7. The serpentine delay line structure of claim 1, wherein the substrate further includes a grounding layer, and the substrate is laminated in order by the layout layer, the first dielectric layer, the second dielectric layer and the grounding layer.

* * * * *